US008602817B2

(12) United States Patent
Chen et al.

(10) Patent No.: US 8,602,817 B2
(45) Date of Patent: Dec. 10, 2013

(54) CONNECTOR ASSEMBLY

(75) Inventors: Yun-Lung Chen, New Taipei (TW); Yi Shu, Wuhan (CN)

(73) Assignees: Hong Fu Jin Precision Industry (WuHan) Co., Ltd., Wuhan (CN); Hon Hai Precision Industry Co., Ltd., New Taipei (TW)

( * ) Notice: Subject to any disclaimer, the term of this patent is extended or adjusted under 35 U.S.C. 154(b) by 51 days.

(21) Appl. No.: 13/414,840

(22) Filed: Mar. 8, 2012

(65) Prior Publication Data

US 2012/0322301 A1 Dec. 20, 2012

(51) Int. Cl.
*H01R 13/66* (2006.01)

(52) U.S. Cl.
USPC ..... 439/540.1; 439/939

(58) Field of Classification Search
USPC ..... 439/540.1, 939, 701
See application file for complete search history.

(56) References Cited

U.S. PATENT DOCUMENTS 6,752,663 B2 * 6/2004 Bright et al. ..... 439/607.25
6,846,200 B1 * 1/2005 Hsu ..... 439/540.1
7,503,802 B2 * 3/2009 Tu et al. ..... 439/540.1
7,914,323 B2 * 3/2011 Hung et al. ..... 439/540.1
8,011,952 B1 * 9/2011 Zhong et al. ..... 439/540.1
8,157,584 B2 * 4/2012 Zhou et al. ..... 439/541.5
8,221,160 B2 * 7/2012 Liu et al. ..... 439/540.1
8,267,722 B2 * 9/2012 Zhou et al. ..... 439/607.25
2004/0077193 A1 * 4/2004 Peloza et al. ..... 439/83
2007/0149045 A1 * 6/2007 Caveney et al. ..... 439/540.1
2009/0269977 A1 * 10/2009 Chen et al. ..... 439/540.1
2010/0227500 A1 * 9/2010 Shih ..... 439/540.1
2011/0237120 A1 * 9/2011 Zhong et al. ..... 439/540.1

* cited by examiner

*Primary Examiner* — Gary Paumen
(74) *Attorney, Agent, or Firm* — Altis Law Group, Inc.

(57) ABSTRACT

A connector assembly includes a first connector connected to a first main line, a second connector connected to a second main line, a first bracket, and a second bracket. The first bracket defines a first receiving opening, a second receiving opening, and a plurality of cutouts. A plurality of hooks is located on the first bracket. The second bracket includes a plurality of second cutouts and a plurality of engaging portions. The first connector is located in the first receiving opening. The second connector is located in the second receiving opening. The plurality of hooks engages on the plurality of engaging portions. The plurality of first cutouts is aligned to the plurality of second cutouts. The first main line and the second main line are placed in the plurality of first cutouts and second cutouts.

19 Claims, 4 Drawing Sheets

CONNECTOR ASSEMBLY

BACKGROUND

1. Technical Field

The present disclosure relates to connector assemblies, more particularly, to a connector assembly for an electronic device.

2. Description of Related Art

Connectors are used in computers and servers to transmit power or signals to peripheral devices. For different peripheral devices, the computers or servers often need different connectors, such as USB connector, IEEE 1394 connectors, and the like. In related art, each of these connectors is separately mounted on the computer, which results in complex and difficult assembly and lack of adaptability in use.

Therefore, there is room for improvement within the art.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Figure 1:
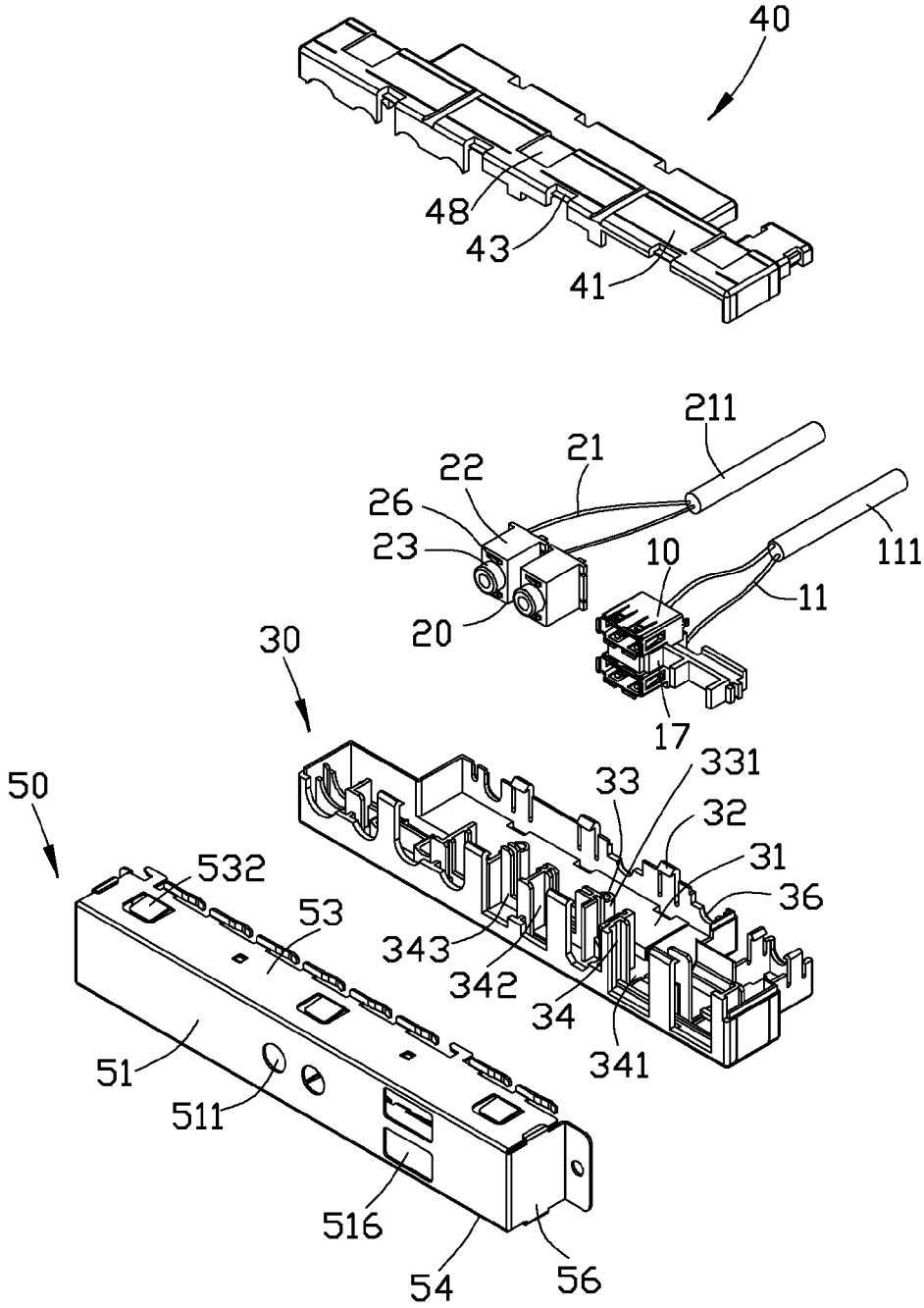
FIG. 1 is an exploded and isometric view of a connector assembly of an embodiment.

Referring to FIG. 1, a connector assembly in accordance with an embodiment, includes two first connectors 10, two second connectors 20, a first bracket 30, a second bracket 40, and a frame 50. In one embodiment, each of the two first connectors 10 is a USB connector, and each of the two second connectors 20 is a signal input and output connector for audio.

The first bracket 30 includes a first piece 31. Opposite edges of the first piece 31 have a plurality of hooks 32 formed thereon. A sleeve 331 is located on the first piece 31. The sleeve 331 defines a mounting hole 33. A front portion of the first piece 31 has a plurality of restricting pieces 34. A first receiving opening 341 is defined between first two of the plurality of restricting pieces 34. A second receiving opening 342 is defined between second two of the plurality of restricting pieces 34. A third receiving opening 343 is defined between third two of the plurality of restricting pieces 34. A rear portion of the first piece 31 defines a plurality of first cutouts 36. Each of the plurality of first cutouts 36 is in the shape of a semicircle.

Figure 2:
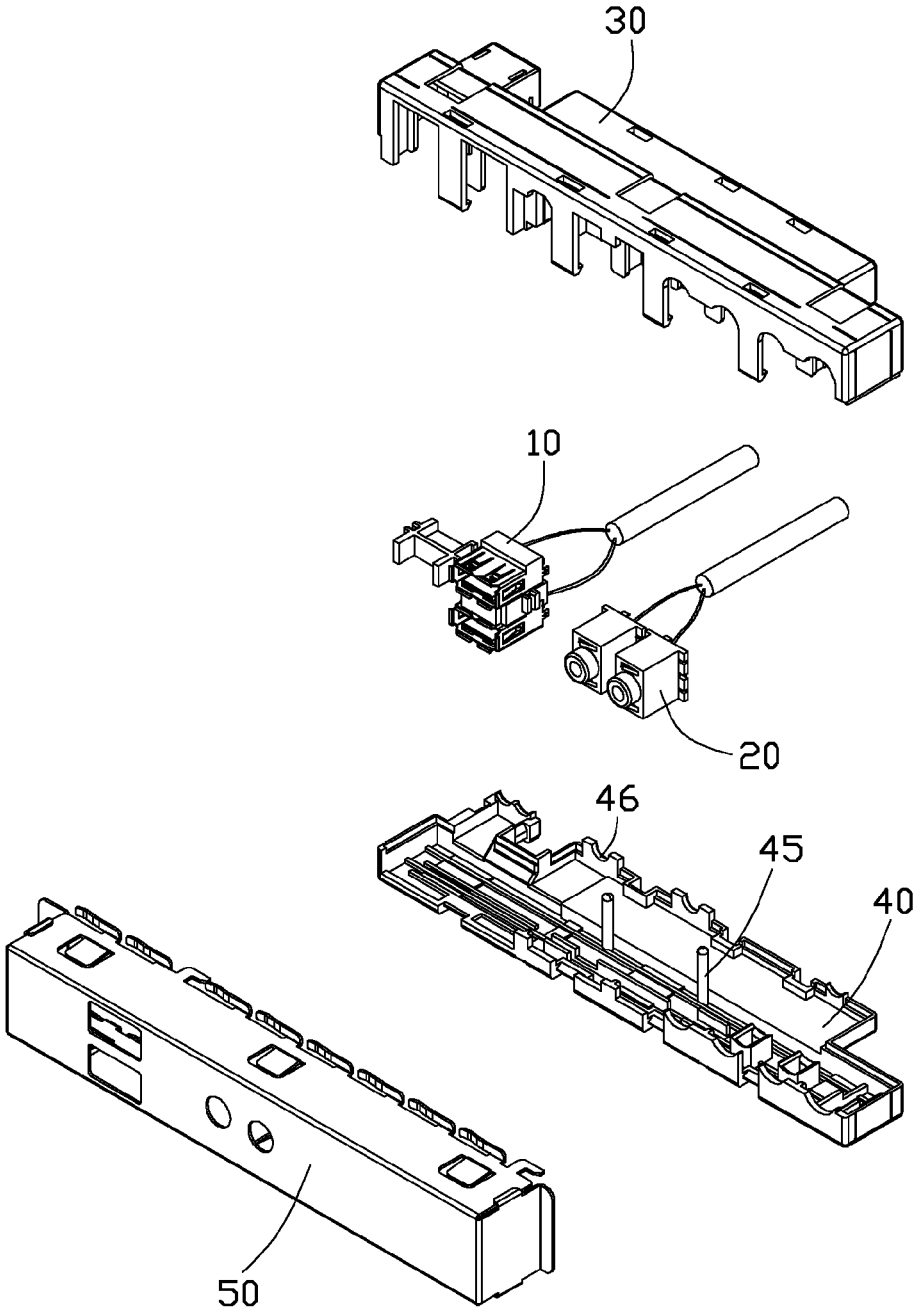
FIG. 2 is similar to FIG. 1, but viewed from another aspect.
Figure 3:
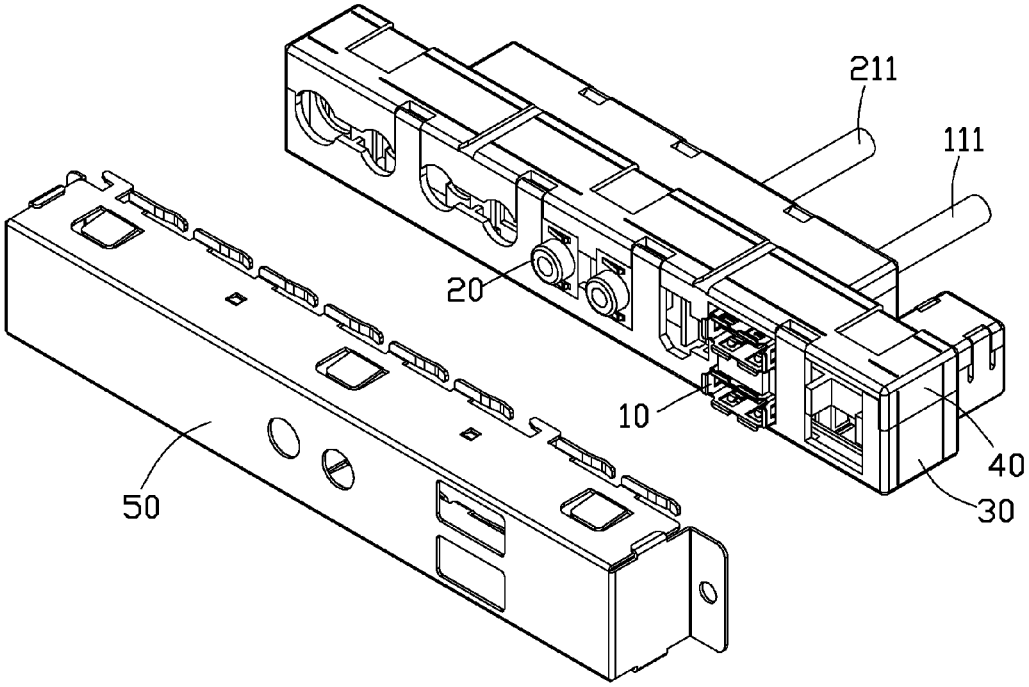
FIG. 3 is a partially assembled view of the connector assembly of FIG. 1.
Figure 4:
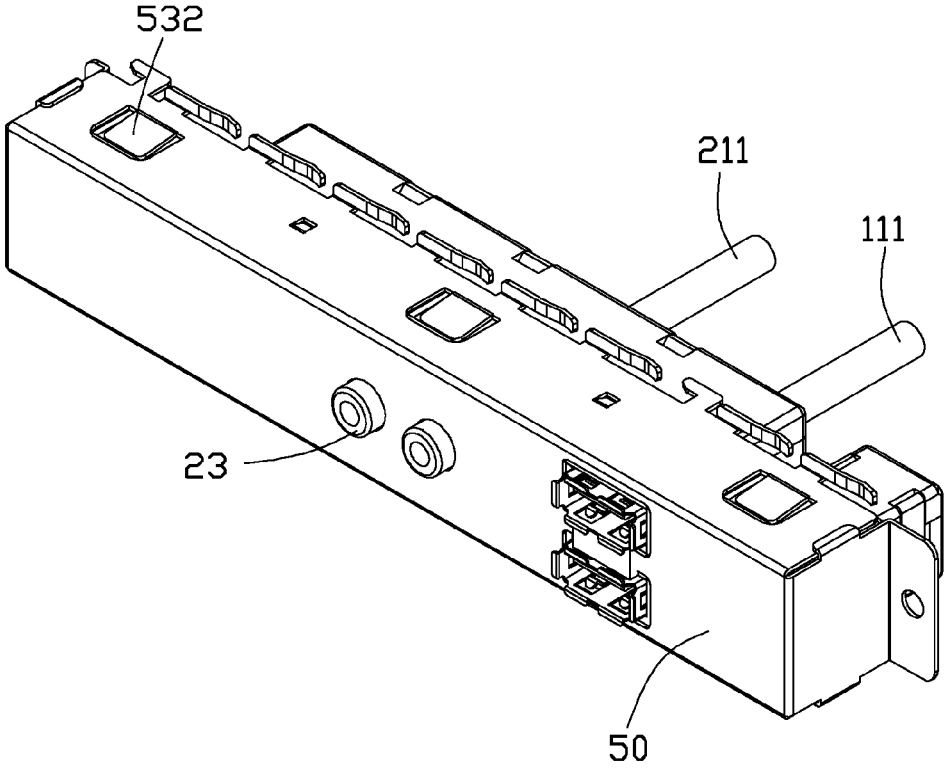
FIG. 4 is an assembled view of the connector assembly of FIG. 1.

Referring to FIGS. 1 and 2, the second bracket 40 includes a second piece 41. Opposite edges of the second piece 41 have a plurality of engaging portions 43 formed thereon corresponding to the plurality of hooks 32. A plurality of mounting posts 45 is located on a side of the second piece 41, which faces the first piece 31. An opposite side of the second piece 41 defines a plurality of engaging recesses 48. A rear portion of the second piece 41 defines a plurality of second cutouts 46 corresponding to the plurality of first cutouts 36. In an embodiment, each of the plurality of second cutouts 46 is in the shape of a semicircle.

The frame 50 includes a front plate 51. A top edge of the front plate 51 extends perpendicularly to form a top plate 53. A bottom edge of the front plate 51 extends perpendicularly to form a bottom plate 54. Left and right edges of the front plate 51 extend perpendicularly to form a pair of side plates 56. The front plate 51 defines two first receiving holes 516 corresponding to the first receiving opening 341. The two first receiving holes 516 are located one above the other. Each of the two first receiving holes 516 is rectangular. The front plate 51 defines two second receiving holes 511 corresponding to the second and the third receiving openings 342 and 343.

The two second receiving holes 511 are located side by side. In an embodiment, each of the two second receiving holes 511 is circular. The top plate 53 forms a plurality of clasps 532 corresponding to the plurality of engaging recesses 48 of the second bracket 40. One end of each of the plurality of clasps 532 is connected on the top plate 53. The other end of the each of the plurality of clasps 532 is free and slightly inclined so as to extend into the frame 50.

Each of the two first connectors 10 is connected to a first branch line 11. The branch line 11 of each of the two first connectors 10 is connected to a first main line 111. Each of the two second connectors 20 is connected to a second branch line 21. The second branch line 21 of each of the two second connectors 20 is connected to a second main line 211. The two first connectors 10 are located one above the other. The two second connectors 20 are located side by side. Each of the two second connectors 20 includes a main body 22 and a jack 23 connected to the main body 22. The main body 22 forms two elastic slices 26 located adjacent the jack 23.

Referring to FIGS. 1 to 4, in assembly of the connector assembly, a block of conductive foam 17 is sandwiched between the two first connectors 10. The two first connectors 10 and the conductive foam 17 are placed in the first receiving opening 341. The first main line 111 is placed in one of the plurality of first cutouts 36. One of the two second connectors 20 is placed in the second receiving opening 342 and the other in the third receiving opening 343. The second main line 211 is placed in another one of the plurality of first cutouts 36.

Then, the plurality of mounting posts 45 of the second bracket 40 are inserted in the mounting holes 33 of the first bracket 30. The plurality of hooks 32 of the first bracket 30 clasp the plurality of engaging portions 43. The plurality of second cutouts 46 match with the plurality of first cutouts 36 to together receive the first main line 111 and the second main line 211 therein.

The first bracket 30 and the second bracket 40 are moved in the frame 50. The two first connectors 10 are aligned to the first receiving holes 516. The conductive foam 17 contacts the front plate 51 to provide shielding against electro magnetic interference. The jack 23 of each of the two second connectors 20 is aligned to each of the two second receiving holes 511. The two elastic slices 26 contact the front plate 51 to provide shielding against electro magnetic interference. The plurality of clasps 532 of the frame 50 engage in the plurality of engaging recesses 48 to mount the first bracket 30 and the second bracket 40 in the frame 50. Thereby, the assembly of the connector assembly is completed. When the connector assembly is mounted in a computer enclosure, the two first connectors 10 and the two second connectors 20 are mounted to the computer enclosure to provide convenient accessibility.

It is to be understood, however, that even though numerous characteristics and advantages of the embodiments have been set forth in the foregoing description, together with details of the structure and functions of the embodiments, the disclosure is illustrative only, and changes may be made in detail, especially in the matters of shape, size, and arrangement of parts within the principles of the invention to the full extent indicated by the broad general meaning of the terms in which the appended claims are expressed.

What is claimed is:

1. A connector assembly, comprising:

a first connector connected to a first main line;

a second connector connected to a second main line;

a first bracket defining a first receiving opening and a second receiving opening, a plurality of hooks located on the first bracket, a plurality of first cutouts defined in the first bracket, the first bracket comprising a sleeve which defines a mounting hole; and a second bracket comprising a plurality of second cutouts and a plurality of engaging portions, the second bracket comprising a mounting post;

wherein the first connector is located in the first receiving opening, the second connector is located in the second receiving opening, each of the plurality of hooks engages on each of the plurality of engaging portions, the mounting post is inserted in the mounting hole to secure the first bracket and the second bracket together, each of the plurality of first cutouts aligned to each of the plurality of second cutouts, the first main line is placed in one of the plurality of first cutouts, and the second main line is placed in one of the plurality of second cutouts.

2. The connector assembly of claim 1, wherein each of the plurality of first cutouts and each of the plurality of second cutouts is semicircle shaped.

3. The connector assembly of claim 1, further comprising a frame, wherein the first bracket and the second bracket are assembled in the frame.

4. The connector assembly of claim 3, wherein the second bracket defines a plurality of engaging recesses, and the frame comprises a plurality of clasps, each of the plurality of claps is engaged in each of the plurality of engaging recesses.

5. The connector assembly of claim 4, wherein one end of each of the plurality of clasps is connected on the frame, and another end of the each of the plurality of clasps is free and slightly inclined to extend into the frame.

6. The connector assembly of claim 3, wherein the frame comprises a front plate, the front plate defines a first receiving hole and a second receiving hole, the first receiving hole is aligned to the first connector, the second receiving hole is aligned to the second connector, the first connector is accessible via the first receiving hole, and the second connector is accessible via the second receiving hole.

7. The connector assembly of claim 6, wherein a conductive foam is secured to the first connector, and the conductive foam contacts the front plate.

8. The connector assembly of claim 6, wherein the second connector comprises an elastic slice, and the elastic slice contacts the front plate.

9. The connector assembly of claim 1, wherein the first bracket comprises a plurality of restricting pieces, and the first receiving opening and the second receiving opening are defined among the plurality of restricting pieces.

10. The connector assembly of claim 1, wherein another first connector is connected to the first main line, the two first connectors are oriented vertically, another second connector is connected to the second main line, and the two second connectors are oriented horizontally.

11. A connector assembly, comprising:

two first connectors oriented vertically, the two first connector connected to a first main line;

two second connectors oriented horizontally, the two second connector connected to a second main line;

a first bracket defining a first receiving opening and two second receiving openings located in the horizontal direction, a plurality of hooks located on the first bracket, a plurality of first cutouts defined in the first bracket, the first bracket comprising a sleeve which defines a mounting hole; and a second bracket comprising a plurality of second cutouts and a plurality of engaging portions, the second bracket comprising a mounting post;

wherein each of the two first connector is located in the first receiving opening, each of the two second connectors is located in each of the two second receiving openings, each of the plurality of hooks engages on each of the plurality of engaging portions, the mounting post is inserted in the mounting hole to secure the first bracket and the second bracket together, each of the plurality of first cutouts is aligned to each of the plurality of second cutouts, the first main line is placed in one of the plurality of first cutouts, and the second main line is placed in one of the plurality of second cutouts.

12. The connector assembly of claim 11, wherein each of the plurality of first cutouts and each of the plurality of second cutouts is semicircle shaped.

13. The connector assembly of claim 11, further comprising a frame, wherein the first bracket and the second bracket are assembled in the frame.

14. The connector assembly of claim 13, wherein the second bracket defines a plurality of engaging recesses, and the frame comprises a plurality of clasps, each of the plurality of claps is engaged in each of the plurality of engaging recesses.

15. The connector assembly of claim 14, wherein one end of each of the plurality of clasps is connected on the frame, and another end of the each of the plurality of clasps is free and slightly inclined to extend into the frame.

16. The connector assembly of claim 13, wherein the frame comprises a front plate, the front plate defines two first receiving holes and two second receiving holes, each of the two first receiving holes is aligned to each of the two first connectors, each of the two second receiving holes is aligned to each of the two second connectors, each of the two first connectors is accessible via each of the two first receiving holes, and each of the two second connectors is assessable via each of the two second receiving holes.

17. The connector assembly of claim 16, wherein a conductive foam is secured between the two first connectors, and the conductive foam contacts the front plate.

18. The connector assembly of claim 16, wherein each of the two second connectors comprises an elastic slice, and the elastic slice contacts the front plate.

19. The connector assembly of claim 11, wherein the first bracket comprises a plurality of restricting pieces, and the first receiving opening and the two second receiving openings are defined among the plurality of restricting pieces.

* * * * *